US008541717B2

(12) United States Patent
Hembise

(10) Patent No.: US 8,541,717 B2
(45) Date of Patent: Sep. 24, 2013

(54) DEVICE FOR REMOTELY DETONATING EXPLOSIVES

(75) Inventor: Dominique Hembise, Plaisir (FR)

(73) Assignee: MBDA France, Paris (FR)

( * ) Notice: Subject to any disclaimer, the term of this patent is extended or adjusted under 35 U.S.C. 154(b) by 164 days.

(21) Appl. No.: 13/133,361

(22) PCT Filed: Dec. 8, 2009

(86) PCT No.: PCT/FR2009/052436

§ 371 (c)(1),
(2), (4) Date: Jun. 7, 2011

(87) PCT Pub. No.: WO2010/067000

PCT Pub. Date: Jun. 17, 2010

(65) Prior Publication Data

US 2011/0233188 A1 Sep. 29, 2011

(30) Foreign Application Priority Data

Dec. 10, 2008 (FR) ..... 08 06924

(51) Int. Cl.
*H05B 1/02* (2006.01)
*B63G 7/02* (2006.01)

(52) U.S. Cl.
USPC ..... 219/482; 219/483; 219/502; 89/1.13; 392/416

(58) Field of Classification Search
CPC ..... H05B 1/02
USPC ..... 218/482, 483–486, 502; 392/416–418; 89/1.13; 702/127
See application file for complete search history.

(56) References Cited

U.S. PATENT DOCUMENTS

| | | | | |
|---|---|---|---|---|
| 5,668,342 | A * | 9/1997 | Discher | 86/50 |
| 7,130,624 | B1 * | 10/2006 | Jackson et al. | 455/420 |
| 7,987,068 | B2 * | 7/2011 | Schultz et al. | 702/127 |
| 2004/0200341 | A1 * | 10/2004 | Walters et al. | 89/1.13 |
| 2005/0235739 | A1 * | 10/2005 | Lovell et al. | 73/53.01 |
| 2008/0134869 | A1 | 6/2008 | Goldman et al. | |

FOREIGN PATENT DOCUMENTS

| | | | |
|---|---|---|---|
| EP | 1 054 230 | A | 11/2000 |
| GB | 2 434 349 | A | 7/2007 |
| JP | 2007-183065 | A | 7/2007 |

OTHER PUBLICATIONS

International Search Report completed Mar. 12, 2010 and mailed Mar. 31, 2010 from corresponding International Application No. PCT/FR2009/052436, filed Dec. 8, 2009 (5 pages).
Written Opinion completed Mar. 12, 2010 and mailed Mar. 31, 2010 from corresponding International Application No. PCT/FR2009/052436, filed Dec. 8, 2009 (11 pages).

* cited by examiner

*Primary Examiner* — Mark Paschall
(74) *Attorney, Agent, or Firm* — Klein, O'Neill & Singh, LLP

(57) ABSTRACT

The present disclosure relates to a device for remotely detonating explosives. According to the present disclosure, the device includes: a heat source in the form of an electric generator for generating a thermal infrared signal, capable of producing two heating zones and mounted in a casing; and a mobile supporting structure bearing the casing at the front and connected to a vehicle at the rear.

20 Claims, 3 Drawing Sheets

DEVICE FOR REMOTELY DETONATING EXPLOSIVES

CROSS-REFERENCE TO RELATED APPLICATION(S)

This is a national phase application under 35 U.S.C. §371 of PCT Application No. PCT/FR2009/052436, filed Dec. 8, 2009, which claims the benefit of French application No. 08/06924 filed Dec. 10, 2008, the contents of which are expressly incorporated herein by reference.

FIELD OF ART

The present disclosure relates to a device for remotely detonating explosives, such as, specifically, mines or improvised explosive devices, provided with a triggering infrared sensor.

BACKGROUND

As known, such a type of explosives is a significant threat to vehicles (and of course, to their passengers) circulating on roads or runways to be secured, as they detonate as a function of the heat being emitted by hot sources from these vehicles, such as the engine, the exhausting line and other systems or devices able to heat upon the operation thereof, and being detected by temperature sensitive infrared sensors and associated with such explosives for detonating them.

Moreover, as such explosives are most often laid on ground or partially or completely buried on the verges of roads covered by vehicles, they are not inevitably detected and detonated by the mine-clearing vehicles generally adapted for securing the road itself they follow and less the verges thereof. Moreover, taking into account false alarms occurring from the different and numerous systems for remotely detecting mines and improvised explosive devices, it is not technically possible to detect all the explosives located aside the road even located at some meters from the latter.

In order to more efficiently fighting against such explosives provided with a detection infrared sensor, the document JP 2007183065 discloses a device for destroying mines with triggering infrared sensor, consisting in a pilotless rolling vehicle, provided with a thermal source and thus operating as a decoy for the mine infrared sensor, said mine exploding upon the passage of the pilotless vehicle through triggering its sensor being decoyed by the thermal source. Afterwards, the vehicles can continue their progression wholly safely at least as far as such a type of explosives is concerned.

However, the efficiency of such a destruction vehicle is not total with respect to such explosives, as the infrared sensors might have variable operating thermal ranges. Furthermore, such a vehicle and the thermal source thereof are most often destroyed and made unusable, so that their use is particularly expensive.

The aim of the present method, system and device is to overcome such drawbacks and relates to a device for detonating explosives of the above described type, the design of which enables to act as a decoy on every explosive activated by a thermal sensor while being technically simple to manufacture.

SUMMARY

To this end, the device for detonating explosives, such as more specifically mines or improvised explosive devices, provided with a triggering infrared sensor of the type comprising a heat source for remotely activating said infrared sensor and detonating said explosive, is remarkable, according to the present method, system and device:

- in that said heat source is a controllable thermal infrared signal electric generator being able to produce at least two heating zones having different modulating operating temperatures, and being mounted in a casing providing, through at least one of its walls, the thermal radiation of said heating zones; and
- in that it comprises a mobile supporting structure bearing, at the front thereof, said casing and able to be connected, at the rear, to a motorised vehicle.

Thus, thanks to the various heating zones of the generator, the device of the present method, system and device could cover different accurate temperatures so as to decoy the infrared sensors of explosives integrating, more specifically, signal processings on the temperature of the detected target (vehicle), for instance, a <<low>> temperature for the thermal signature of the engine of the vehicle and a <<high>> temperature for the thermal signature of the exhausting line of the engine. Thus, it is ensured that such a type of explosives is detonated through the thermal radiation of the heating zones of the device decoying the sensors of the explosives.

Furthermore, as the electric generator is housed in the casing, it is protected from possible projections or fragments resulting from explosives being detonated, so that the heating zones remain active.

Finally, the device is a simple structure coupled to the front of the pushing motorised vehicle, so that the design thereof is technically simple and less expensive than an autonomous pilotless vehicle.

Advantageously, in order to limit the thermal conduction between the two heating zones, these are thermally separated apart by openings arranged in said wall of the casing, between said two zones.

Furthermore, for safety reasons, the device comprises a protection grid fastened externally on the wall of said casing, before the high temperature heating zone.

For instance, said heating zones at modulating temperature are produced by electric resistor networks arranged on said wall of the casing. The simplicity of the design of the heating zones in the thermal generator is to be noticed.

Moreover, said heating zones are preferably connected to a control/command device ensuring their operation and their thermal regulation and monitoring.

In this preferred embodiment, said casing has a flattened substantially parallelepipedic shape, the two opposite large walls of which form said radiating heating zones and are arranged in substantially vertical planes oriented respectively on either sides of the shifting direction for said supporting structure. Thus, the front left and right verges of the road, on which the vehicle drives, pushing the device, are scanned by the radiating walls of the casing so as to decoy the infrared sensors and triggers the explosion of such a type of explosives.

In particular, each large wall of said casing comprises said two distinct heating zones.

According to another feature of the present method, system and device, said supporting structure has the shape of a beam, on the front end of which said thermal casing is mounted and which is able to be connected, at its rear end, to fastening points of said vehicle. Thus, the device is mounted in overhang, well remotely from the pushing vehicle, protecting the latter from the explosion of the explosive loads. Moreover, there again, the outstanding simplicity of the design of the supporting structure is to be noticed, reducing the manufacturing costs of such devices.

For instance, mounting said casing on the front end of the structure is preferably of the hinge suspension type around a hinging axis substantially horizontal according to the shifting direction of said structure.

For protection purposes, the front of said supporting is bent upwardly so as to approximately form a reversed C wherein said casing is arranged.

Furthermore, when it is not in operation, said supporting structure could be lifted compared to the vehicle and locked in a lifted position.

BRIEF DESCRIPTION OF THE FIGURES

The FIGS. of the appended drawing will better explain how the present method, system and device can be implemented. In these FIGS., like reference numerals relate to like components

DETAILED DESCRIPTION

Figure 1:
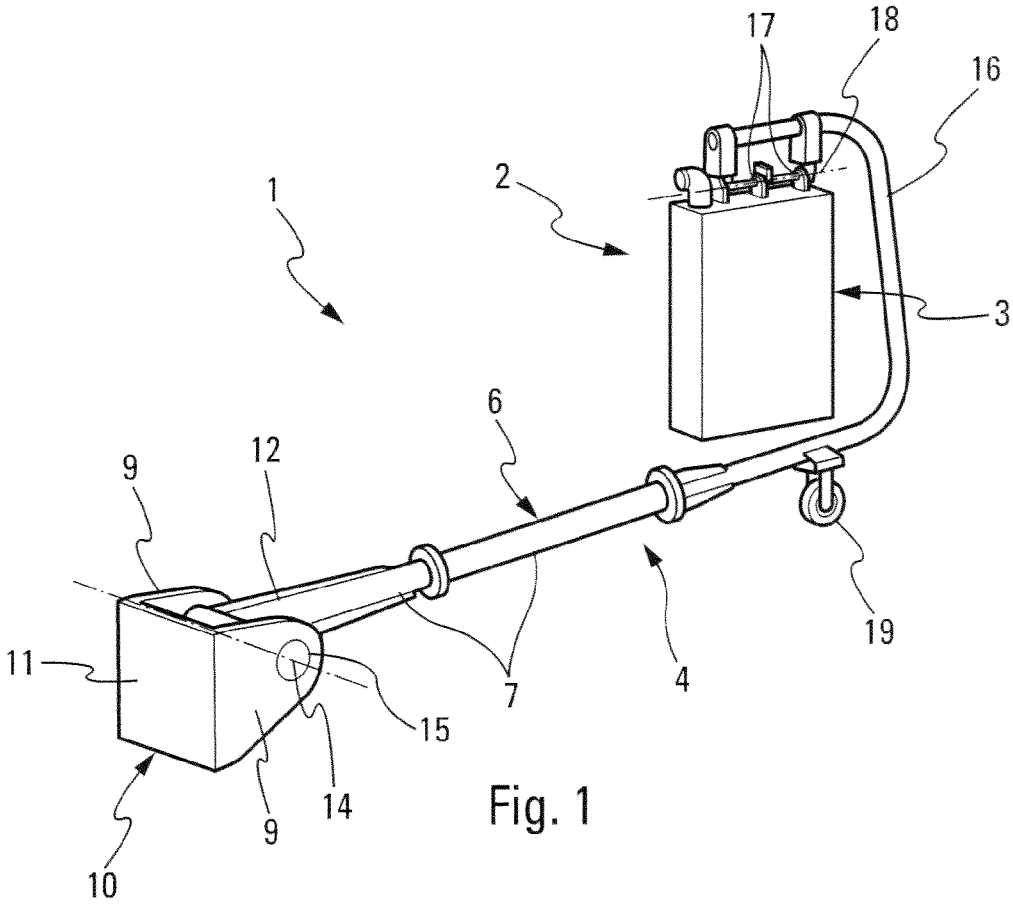
FIG. 1 is a perspective view of an embodiment of a device for detonating explosives according to the present method, system and device.
Figure 2:
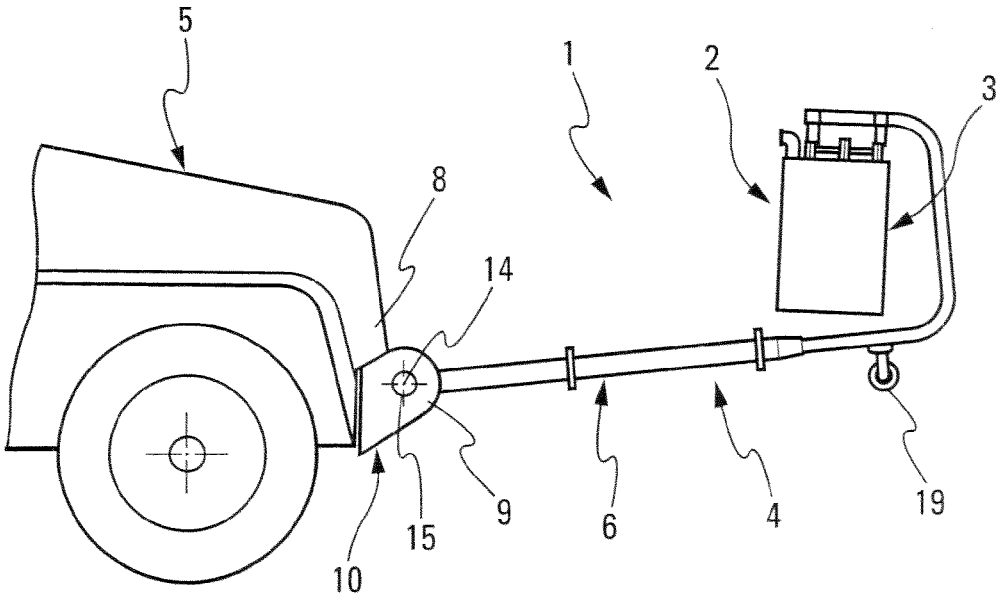
FIG. 2 is a plane view of the device of the present method, system and device mounted at the front of the vehicle.
Figure 3:
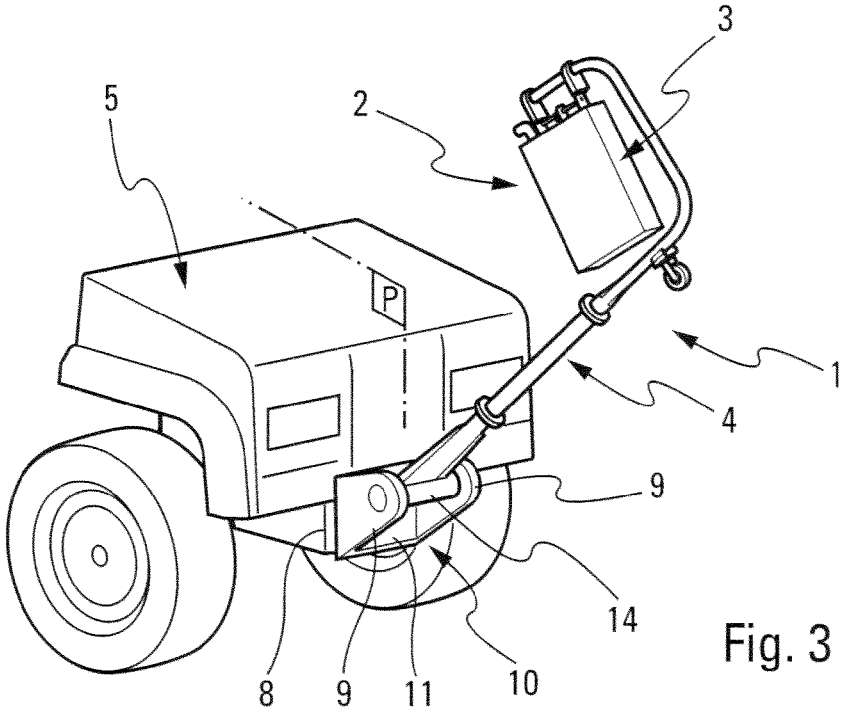
FIG. 3 shows the device attached to the vehicle in a lifted position.

The device 1, shown on FIGS. 1 to 3, is intended for detonating non shown explosives, such as mines and/or improvised explosive devices provided with a triggering infrared sensor. To this end, the device 1 comprises an thermal infrared signal electric generator 2 acting as a thermal source intended for decoying the infrared sensors of the explosives, so that they detonate, a protective casing 3 including the electric generator 2 and a bearing structure 4 of the casing 3, intended for being mounted at the front of a motorised vehicle 5 of the military type.

In particular, the hearing structure 4 has the shape of a beam 6 comprising rigidly assembled tubular parts 7 and being arranged in the vertical longitudinal symmetry plane P (FIG. 3) of the vehicle, so as to put the electric generator 2 apart from the front 8 of the vehicle 5, for ensuring a detonation of the explosives before the vehicle drives by (including the hot sources thereof as the engine and the exhaust line) before them. Thus, for mounting the bearing structure 4 of the device 1 on the vehicle 5, advantageously, the strong towing points are used, provided at the front 8 of the military vehicles and being defined by two parallel towing rings 9 issued, as shown on FIGS. 1 to 3, from a U-shaped yoke 10, having its base fixedly arranged on the body of the vehicle. Naturally, the U-shaped yoke is symmetrically arranged with respect to the vertical longitudinal symmetry plane of the vehicle 5 and the then widened proximal end 12 of the beam is introduced between the parallel rings 9 of the yoke 10 and connected to them via an axis 14 crossing the horizontal aligned eyelets 15 of the towing rings.

The distal end 16 of the beam is as far as it is concerned bent upwardly so as to form a reversed C wherein the casing 3 is arranged, so as to put it, with its thermal source, at some height from the ground (substantially corresponding to that of the engine and the exhaust line of the vehicle) and to protect is from possible shocks with obstacles during the mission. The casing 3 preferably hangs at the distal end 16 of the beam 6 via a hinge quick connection 17 integrating a substantially horizontal hinging axis 18, contained in the vertical longitudinal symmetry plane of the vehicle 5, so that the casing 3 has a lateral degree of freedom while being able to oscillate around said axis 18.

Thus, as can be seen on FIG. 2, the device 1 longitudinally projects with respect to the front 8 of the vehicle 5 and is maintained, in such a substantially horizontal position, by any non shown means (abutment, . . . ) for preventing it from rotating, provided at the level of its linking (axis 4) with the vehicle. And a caster 19 is furthermore provided under the distal end 16 of the beam for ensuring a support on the ground of the device 1 and its shift.

Furthermore, it can be seen on FIG. 3, that the detonating device 1 of the present method, system and device can be lifted with respect to the vehicle 5 and can be locked in a high position, as shown, when it is not in operation. To this end, a non shown rotation clamping mechanism of the hinging axis with respect to the towing rings could be provided or any other means for maintaining the device in a lifted position.

Figure 4:
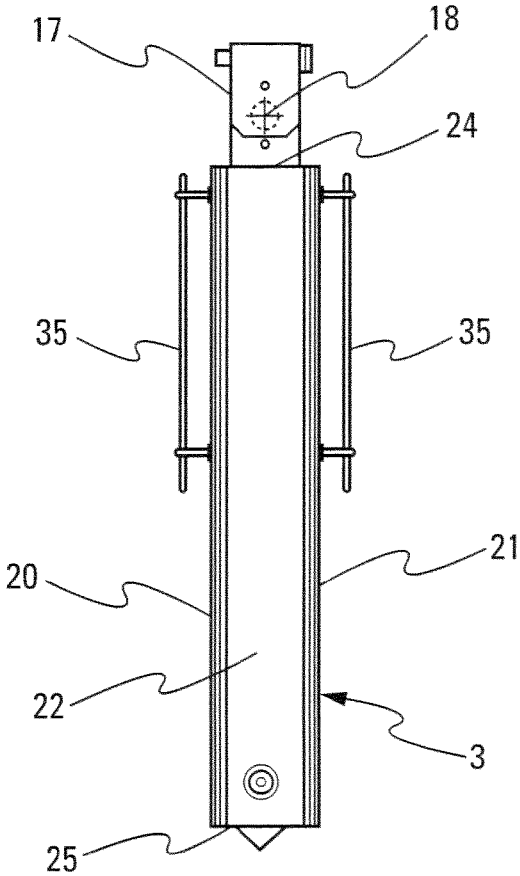
FIG. 4 is a front view of the casing of the device.
Figure 5:
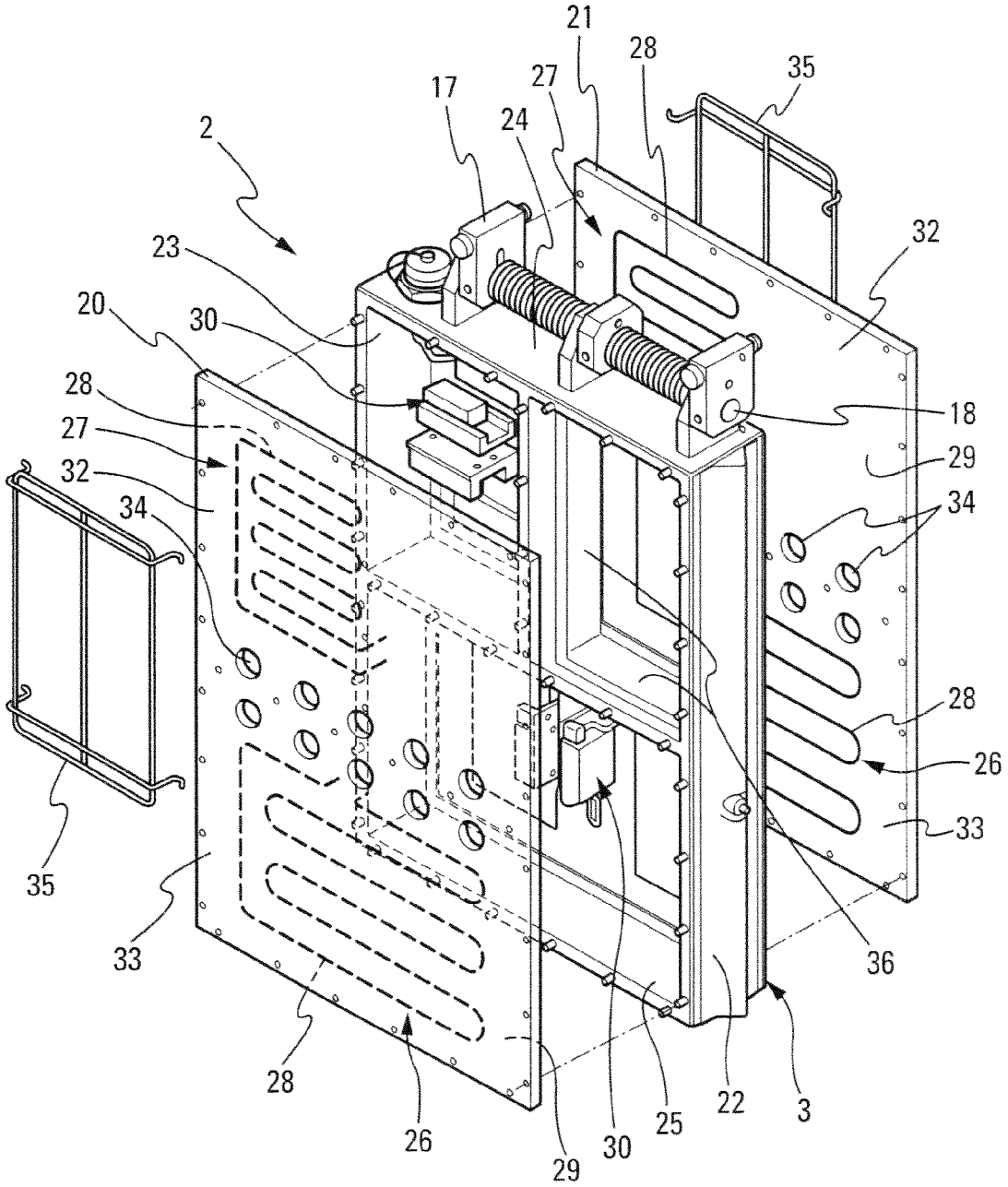
FIG. 5 is an exploded perspective view of the casing of the device comprising said heat source.

As more particularly shown on FIGS. 4 and 5, the casing 3 of the electric generator 2 has a rather flattened parallelepipedic shape, defined by two main opposite or large walls or plates 20 and 21, parallel to the vertical longitudinal symmetry plane of the vehicle and connected one to the other by four lateral walls opposite two by two, respectively front, rear 22, 23 and higher, lower 24, 25. One of these lateral walls, in the present case, the higher wall 24, externally bears the corresponding hinges 17 of the hinging axis 18 connecting the hanging casing 3 to the bent distal end 16 of the beam 6.

Also, in the embodiment of the present method, system and device, the two main walls 20, 21 of the casing are metallic and act as radiating heating zones produced by the electric generator 2 thanks to electric resistor networks 28 fastened to the inner side 29 of the walls 20 and 21. Such resistors are connected to the power supply of the vehicle 5 by a non shown wire 5, going through the beam 6 of the bearing structure 4, by means of a control/command device 30 housed in the casing and ensuring, amongst others, the operation of the resistors, the regulation of their temperature and the triggering of an alarm in the case of a malfunction. Thus, the main walls 20, 21 of the casing comprise the radiating surfaces of the decoy, so as to emit an infrared radiation, as well in the direction of the front left side as in the direction of the front right side of the vehicle, for thereby triggering the sensors of the explosives before the vehicle drives by.

As some explosives have "smart" infrared sensors integrating signal processings over the temperature of the detected target (vehicle), each main wall 20, 21 comprises two distinct heating zones 26, 27 having different operating temperatures or temperature ranges. Thus, in the example shown on FIG. 5, a first low temperature zone could be provided, representative of the temperature emitted by the engine of a vehicle, and a second high temperature zone 27, representative of the temperature emitted by its exhaust line, for decoying the infrared sensors.

It is understood that a single temperature zone could be provided on each main wall or more than two zones.

For instance, in the embodiment illustrated on FIG. 5, the high temperature zone 27 is located in the upper part 32 of each wall 20, 21, whereas the low temperature zone 26 is located in the lower part 33 of the walls.

In order to limit the thermal conduction between the high and low temperature zones 26, 27 of each wall, openings 34 are provided in each one of them, separating, to the best, said radiating zones from the casings. The illustrated openings 34 are circular but they could be oblong or have any other shape.

And, for safety reasons, the high temperature radiating zone 27 of each main wall is protected by an external grid 35 fixedly arranged, removably, on the casing. Each low temperature zone 26 could, if this could prove to be necessary, be also covered with a protective grid.

Furthermore, the thermal regulation implemented by the device 30 could be ensured, in such an example, by three temperature sensors (not shown), two for the respective high and low temperature zones and one measuring the room temperature. Thus, in the case of a permanent deviation between the set point temperature of one zone and the measured temperature, an alarm indicating such a dysfunction is triggered and is emitted up to the driver of the vehicle. He is able to control the device of the present disclosure from his driving post by means of an appropriate control casing non shown on the FIGS.

The casing 3 containing the thermal source 2 is further sealed and reinforced, more specifically, by internal walls 36 so as to withstand the blast effect of munitions activated by other infrared decoy triggering means of the present method, system and device and the different generated fragments.

The invention claimed is:

1. A device for detonating explosives, including more specifically mines or improvised explosive devices, of the type comprising:

a heat source for remotely activating an infrared sensor device, said heat source being a controllable infrared signal generator having at least two heating zones operating at two different temperature ranges; and a mobile supporting structure bearing supporting said infrared signal generator having mounting surfaces for mounting to a motorized vehicle; and wherein said infrared signal generator is mounted in a casing comprising a plurality of walls and said at least two heating zones heat at least two different sections of at least one of the plurality of walls of the casing, and wherein said at least two heating zones are thermally separated by openings arranged on said casing.

2. The device according to claim 1, further comprising a protective grid fastened externally of said casing and extending over a wall section of the heating zone with the temperature range that is higher than that of the other temperature zone.

3. The device according claim 1, wherein energy for said heating zones is generated by electric resistor networks arranged on said at least one of the plurality of walls of the casing.

4. The device according to claim 1, wherein said casing has a flattened substantially parallelepipedic shape having two large opposite walls each with heating zones arranged in substantially vertical planes.

5. The device according to claim 4, wherein each large wall of said casing comprises two distinct heating zones.

6. The device according to claim 1, wherein said supporting structure comprises a beam having a first end on which said thermal casing is mounted and a second end having said mounting surfaces for mounting to a motorized vehicle.

7. The device according to claim 6, further comprising a horizontal hinged mount for attaching said casing to said first end of the supporting structure.

8. The device according to claim 1, wherein the first end of said supporting structure is bent so as to approximately form a reversed C.

9. The device according to claim 1, wherein said supporting structure can be lifted relative to the ground and able to be locked in a lifted position.

10. The device according to claim 1, wherein said at least two heating zones are connected to a control device and wherein said control device is configured to regulate and monitor said at least two heating zones.

11. A decoy device for detonating explosives, said decoy device comprising:

a heat source for remotely activating an infrared sensor device, said heat source being a controllable infrared signal generator having at least two spaced apart heating zones with a first zone operating at a first temperature range and a second zone operating at a second temperature range, which is different from the first temperature range; and a control device mounted in a casing comprising a plurality of walls and electrically coupled to the at least two spaced apart heating zones to control power to said at least two heating zones;

wherein said heating zones are thermally separated by openings arranged in a wall of the casing.

12. The decoy device of claim 11, wherein resister networks generate the infrared signal in the heating zones.

13. The decoy device of claim 11, further comprising a support structure supporting the casing at one end of the support structure and connected, at an opposite end, to a motorized vehicle.

14. The decoy device of claim 13, wherein the end supporting the casing is bent in a reverse C shape.

15. The decoy device of claim 13, wherein the decoy device receives power from the motorized vehicle.

16. The decoy device of claim 13, further comprising a wire that runs from the motorized vehicle engine, through the support structure, to the decoy device to power the decoy device.

17. A method for triggering infrared activated explosive devices, comprising:

providing a heat source located inside a casing comprising a plurality of walls;

providing a control device electrically coupled to the heat source; and mounting the control device inside the casing spaced from the heat source;

wherein the heat source comprises at least two heating zones located on one of the walls of the plurality of walls of the casing with each heating zone operating in a temperature range that differs from the other.

18. The method of claim 17, wherein the at least two heating zones comprise resister networks.

19. The method of claim 17, wherein the casing is mounted on a support structure attached to a motorized vehicle.

20. The method of claim 19, wherein the heat source is powered by a wire that runs from the motorized vehicle through the support structure and to the casing.

* * * * *